US007022945B1

(12) United States Patent
Western

(10) Patent No.: US 7,022,945 B1
(45) Date of Patent: Apr. 4, 2006

(54) CONTAINER AND WARMER FOR WIPES AND THE LIKE

(76) Inventor: Stephanie Western, 1325 Prospect Ave., Capitola, CA (US) 95010

( * ) Notice: Subject to any disclaimer, the term of this patent is extended or adjusted under 35 U.S.C. 154(b) by 0 days.

(21) Appl. No.: 10/775,593

(22) Filed: Feb. 9, 2004

Related U.S. Application Data

(60) Provisional application No. 60/446,016, filed on Feb. 8, 2003.

(51) Int. Cl.
*A47K 10/42* (2006.01)
*A47K 7/00* (2006.01)

(52) U.S. Cl. ..... 219/386; 126/263.01; 126/265; 222/146.5

(58) Field of Classification Search ..... 219/385, 219/386; 222/146.5; 126/263.01, 265
See application file for complete search history.

(56) References Cited

U.S. PATENT DOCUMENTS 3,804,076 A * 4/1974 Fant et al. ..... 126/261
4,810,859 A * 3/1989 Anabtawi et al. ..... 219/535
5,210,396 A * 5/1993 Sanders ..... 219/386
5,231,266 A * 7/1993 Warren ..... 219/386
5,738,082 A * 4/1998 Page et al. ..... 126/263.01
5,906,763 A * 5/1999 Warren Van Deventer Wheeler ..... 219/386
6,234,165 B1 * 5/2001 Creighton et al. ..... 126/263.06
6,289,889 B1 * 9/2001 Bell et al. ..... 126/263.07
6,316,750 B1 * 11/2001 Levin ..... 219/438
6,497,341 B1 * 12/2002 Motsenbocker ..... 221/63
6,528,766 B1 * 3/2003 Parks et al. ..... 219/386
6,639,185 B1 * 10/2003 McConnell et al. ..... 219/386
6,703,590 B1 * 3/2004 Holley, Jr. ..... 219/432
6,827,080 B1 * 12/2004 Fish et al. ..... 126/263.01
2002/0174863 A1 * 11/2002 Saric et al. ..... 126/263.05
2004/0168684 A1 * 9/2004 Shapiro et al. ..... 126/265

FOREIGN PATENT DOCUMENTS

JP 11-197049 A * 7/1999
JP 2000-126075 A * 5/2000

OTHER PUBLICATIONS

Instruction Manual for Conair Model CA0262 Cordless Curling Iron (undated).

* cited by examiner

*Primary Examiner*—Joseph Pelham
(74) *Attorney, Agent, or Firm*—J. Carl Cooper

(57) ABSTRACT

A portable baby wipe warmer and container comprising a container for storing baby wipes, a heat source thermally coupled to the container, and a temperature regulating component coupled to the heat source for regulating the heat provided to the container by the heat source.

20 Claims, 3 Drawing Sheets

CONTAINER AND WARMER FOR WIPES AND THE LIKE

This non-provisional patent application claims priority to provisional Ser. No. 60/446,016 filed Feb. 8, 2003.

BACKGROUND OF THE INVENTION

The present invention relates to a portable container for holding and dispensing wipes, for example, baby wipes, hand wipes, and the like. Of particular interest in respect to the present invention are moistened baby wipes made of soft cloths or paper towels and used to clean infants. Baby wipes are typically supplied in bulk in packaging designed to both protect the wipes from damage by contamination and avoid loss of the fluid(s) used to moisten and/or medicate the wipes. This packaging is generally intended to be inexpensive and consequently removing individual wipes from the packaging can be difficult, especially for a person who holds a baby in one hand whiles removing a wipe from the container with the other. Existing containers do not facilitate ease of removal of individual or small numbers of wipes with one hand, especially in travel situations.

In addition, existing containers do not provide for reliable heating of wipes to a controlled range of temperatures. It is desirable, especially for wipes which are being transported, to have warm wipes available for cleaning infants. Often parents will remove a wipe from the package and warm it against their skin before using the wipe to clean the infant. This process is time consuming, annoying to the parent because of the cold wipe against the skin, and inconvenient because of the difficulty in retrieving a wipe from the package. Additionally, it is desirable to carry, keep clean and accessible and warm other articles, for example, baby bottles, pacifiers, diapers, clothing, and the like.

Others in the art have recognized some of the above needs and deficiencies and have attempted to provide solutions thereto. U.S. Pat. No. 5,738,082 to Page, et al. shows a portable baby wipe warmer and container for heating and storing wipes. The container is made of soft fabric material that has at least two compartments with a common heat conduction wall between (col. 1, 1. 51–67). The container has two zippers 5 & 6 for opening (col. 2, 1. 26–28). The container may be used for other baby articles which are enhanced by warmth (col. 2, 1. 18–22). The heat for Page's warmer is provided by an optional heat disc of FIG. 3. The disc is preferably a microwavable gel pack, exothermic gel boil pack, most preferably a microwavable gel pack (col. 3, 1. 5–12). Examples of these gel packs are given (col. 3,1. 12–18) which include the exothermic dry heat organic oxidation pack HotHands™ by Heatmax, Inc. of Dalton, Ga. This product contains a mixture of natural ingredients that when exposed to air react together to produce heat. This is accomplished through an extremely fast oxygenation (or rusting) process. Ingredients include: iron powder, water, salt, activated charcoal and vermiculite. HeatMax, Inc. has perfected the process so that their warmers, depending on the individual product, produce heat anywhere from 100° F. to 180° F. for a duration of 1 to 20+hours. These warmers are used and disposed of in everyday garbage.

While Page's warmer is useful for portable applications, it has several disadvantages, including difficulty in removing the wipes due to the use of zippers 5 & 6 for opening. The use of zippers in conjunction with the soft flexible fabric makes it difficult to open with one hand. In addition, the use of disposable exothermic warmers, or microwavable gel warmers creates problems ensuring a reliable supply of warmer discs. When the microwavable gel warmer has cooled, it must be microwaved again. When the disposable exothermic warmer is used up, it must be replaced. Additionally, there is no suggestion for regulating the temperature of the wipes in the container. While the exothermic warmer may be designed to maintain a specific heat for the warmer itself, there is no suggestion for regulating the amount of heat transferred from this disc to the wipes in the container. Consequently, as Page et al.'s container is exposed to differing ambient heat temperatures and differing heat loss due to the amount and frequency of opening, there is no assurance that the wipes will remain the proper temperature, or within a range of proper temperatures, and may very well be maintained in a too hot or too cold condition. Further, with either of the suggested heat sources, once the disc is inserted in the warmer, it continues to warm and cannot be turned off. This unnecessarily wastes energy and uses up discs when the warmer is only used for short periods of time.

SUMMARY OF THE INVENTION

The present invention relates to a convenient, durable, and easily rechargeable warming container and dispenser for baby wipes and the like. The container serves to carry, store, protect, maintain in a clean state, maintain at a proper temperature or range of temperatures, and/or make conveniently available the contents thereof. It will be recognized that while the invention is described in its preferred embodiment with respect to a dispenser for baby wipes, the invention is equally useful for many other types of wipes, swabs, cloths, pads, towels, and the like, as well as other types of articles which may benefit from being carried, protected, kept in a clean state, warmed and/or made conveniently available. Such wipes and articles may be contained alone or in various combinations as desired by the user.

Applicant herein utilizes the term wipe to include not only baby wipes, but also the many types of wipes, swabs, cloths, pads, towels, and the like which are commonly removed from a container by hand in single or small quantities at a time, and used by hand or with an appliance for cleaning, moistening, treating and/or medicating various surfaces. One of ordinary skill in the art will recognize that the invention described herein by way of example may be utilized for other types of articles which may benefit from being protected, stored, kept in a clean state, warmed, and made conveniently available. Such wipes may be made of cloth, paper, plastic or other material as is known or may come to be known in the art. Examples of wipes, as defined by the inventor, include but are not limited to, dry, moistened and/or medicated swabs, mops, cloths, pads, towels, towelettes, and tissues. Of particular interest in respect to the present invention are moistened baby wipes made of soft cloths or paper towels and used to clean infants, and related baby articles. For certainty herein, in applications where such small quantities mentioned above are not known in the art with sufficient precision to enable understanding of the invention, small quantities shall be less than 13.

The preferred embodiment of the invention preferably includes a durable, rigid or semi-rigid container having dimensions such that holding and carrying with one hand are convenient and having an opening arrangement facilitating one hand operation and removal of items therefrom, insulation to prevent loss of heat, a heating element for heating the contents, an energy source supplying the heating element with energy, a temperature sensing element for sensing the temperature of the contents of the container directly or indirectly, and a controlling element for controlling the temperature of the contents in response to the temperature sensing element. The invention may include other features and configurations which will be known to those of ordinary skill in the art from the teachings herein taken in conjunction with reference to the drawings.

DETAILED DESCRIPTION OF THE INVENTION

Figure 1:
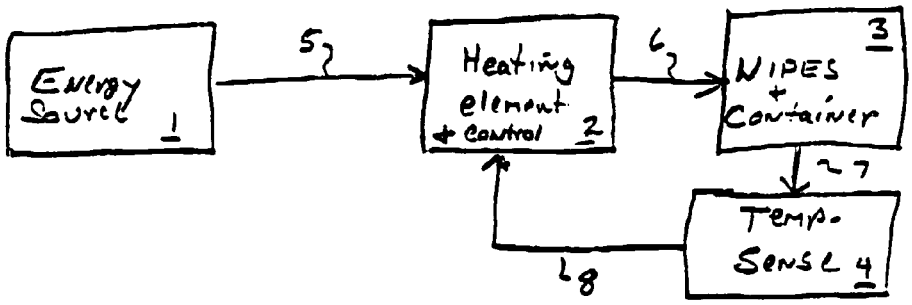
FIG. 1 is a diagram illustrating the principal of the heating system of the invention.
Figure 2:
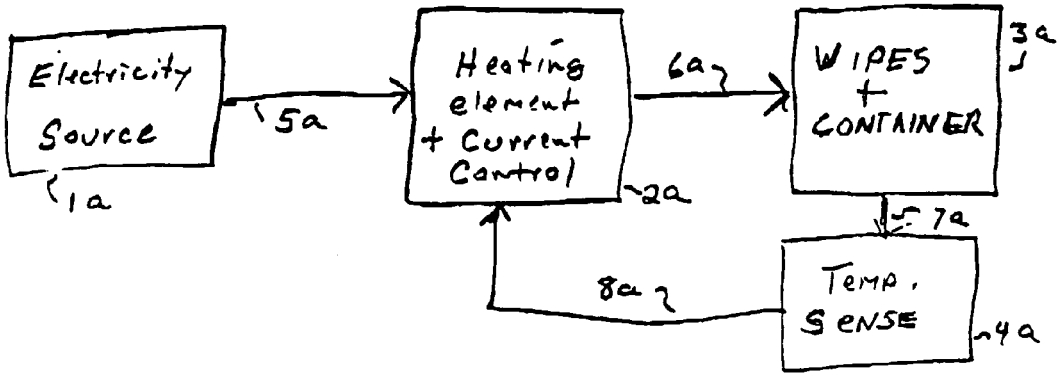
FIG. 2 is a diagram for an embodiment of the heating system of the invention utilizing electricity as an energy source.
Figure 3:
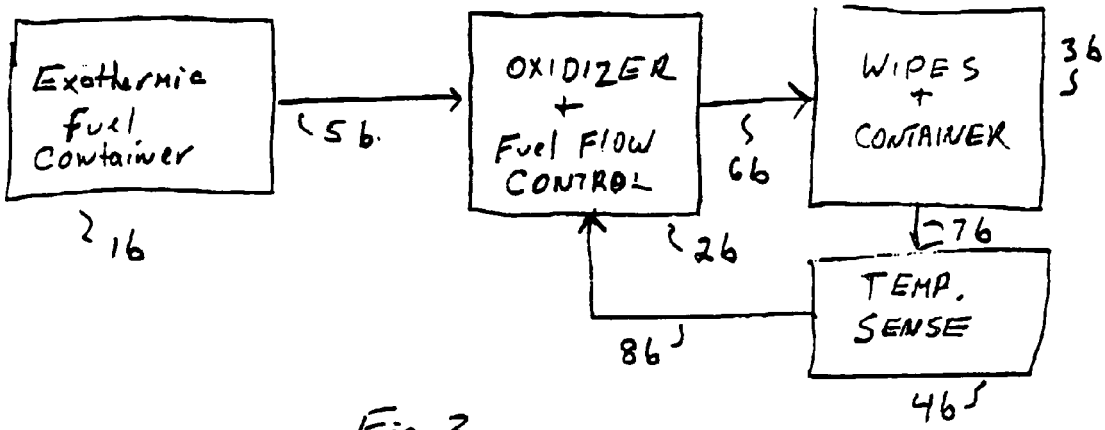
FIG. 3 is a diagram of an embodiment of the heating system of the invention utilizing exothermic fuel as an energy source.
Figure 4:
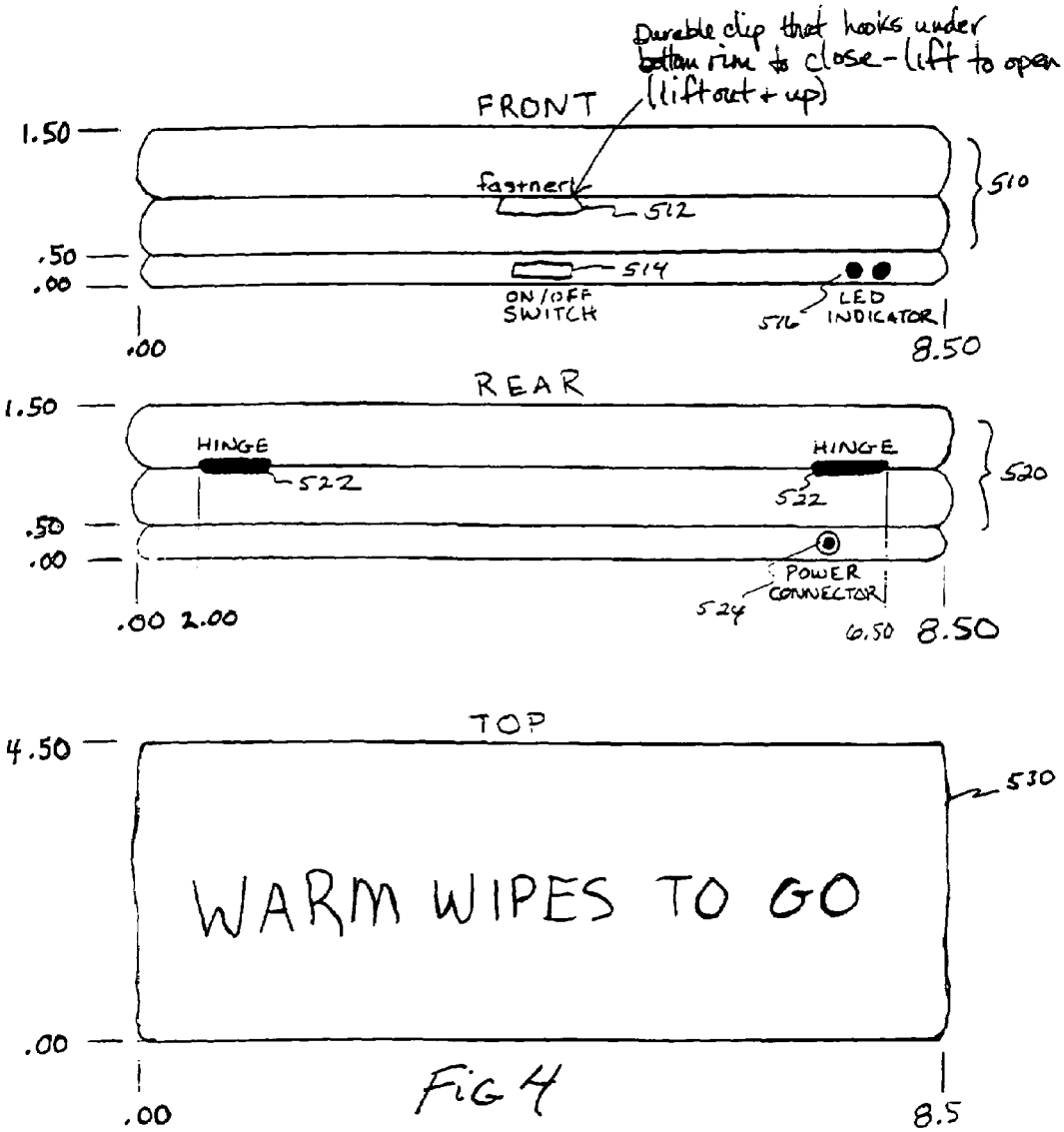
FIG. 4 is a diagram illustrating the principal of the case of the invention.
Figure 5:
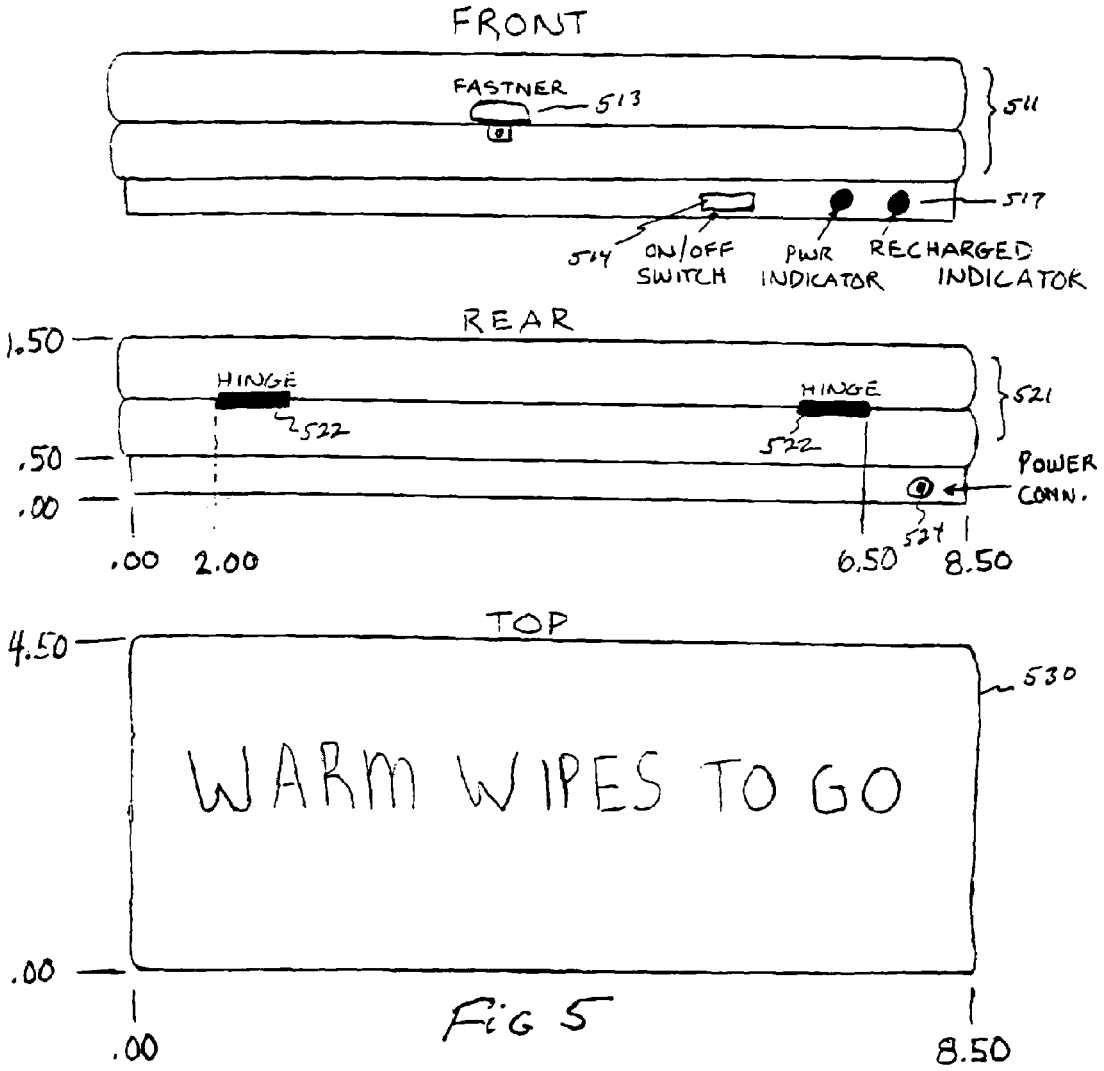
FIG. 5 is a diagram of a detail of the diagram of FIG. 4.

FIGS. 1–3 demonstrate the heating and control of the contents of the container of the invention while FIGS. 4 and 5 demonstrate the container and arrangement of parts thereof in relation to the heating and control portions of the invention.

FIG. 1 shows an energy source 1 which stores energy in a suitable form known to those of ordinary skill, a heating element and control 2 which receives energy from energy source 1 via coupling 5 and converts that energy to heat which heats the container and wipes 3, the temperature of which is sensed directly or indirectly by temperature sense element 4 via coupling 7. The control of heating element 2 is responsive to the temperature sense element 4 via coupling 8 to control the amount of heat produced by 2 to be coupled to 3.

Energy source 1 may be of any known type and may, for example, store energy in electrical or chemical form, for example, such as by battery or fuel container. Heating element and control 2 may be of any known type and form chosen for compatibility with the stored energy of 1 and configuration and expected contents of 3. Examples of heating elements which may be used are restive electrical components, chemical oxidizers such as burners, and catalytic converters. The container 3 will be described in more detail and understood more specifically in respect to the preferred embodiment herein and is preferred to provide sufficient storage space for the needed number of wipes, as well as including insulation to prevent heat loss, and have a mechanical design which facilitates attachment and operation of elements 1, 2 and 4, as well as convenient usage and operation by the user. Temperature sensor 4 may be of any known type and is selected to facilitate operation with the container 3, the particular contents expected to be stored in 3, and the particular energy source 1 and heating element and control 2. Examples of such temperature sense elements include thermostatic controls constructed with bimetallic strips which open and close electrical contacts or fluid or gas valves, thermocouples which produce varying electric potentials in response to varying temperatures, thermally sensitive electronic elements which change resistance or junction voltage in response to varying temperature, and optical sensors which sense the optical (i.e. infrared) radiation given off by warm elements.

It will be understood that combinations of temperature sensors may be utilized, and while sensing 4 and heating and control 2 are shown separately, such functions may be intermixed and combined as is conveniently known in the art. For example, an electronic component may be utilized for temperature control with a bimetal strip used as an over-temperature safety guarding against failure of the primary control. As another example, the heating element may be composed of a restive device having a positive temperature coefficient wherein the current flow through the element is self-limiting to maintain a fixed temperature. Such positive temperature coefficient devices are commonly used for self-resetting fuses. Such an embodiment is shown in FIG. 2.

FIG. 3 illustrates another alternative embodiment wherein the electricity source (5, 5*a*) is replaced with an exothermic fuel container 1*b*, which flows through oxidizer and fuel flow component 2*b* causing heat for wipes and container 36. The general use of exothermic heating is well known.

FIGS. 4 and 5 illustrate embodiments of the case of the present invention. The case includes a front face 510, a rear face 520, and a top 530. Fastener 512, switch 514, indicators 516, hinges 522, and power connector 524 are also shown. FIG. 5 also shows an alternative embodiment with fastener 513 on front 511 and a variation on rear face 521. A variation to indicators 517 is also shown.

What is claimed is:

1. A conveyable warmer for wipes and the like including in combination:

a) a container having an opening arrangement which may be opened to insert said wipes into said container or remove said wipes from said container;

b) a renewable energy source attached or integral to said container for storing energy in gaseous, liquid, or or chemical form;

c) a heat source attached or integral to said container and providing heat to said wipes in response to said energy source;

d) a heat control attached or integral to said container and operative to measure and control the temperature of said wipes inside said container within a range of temperatures by regulating the amount of heat produced by said heat source of c).

2. A mobile warmer for wipes and the like including in combination:

a) a container having a stiff opening arrangement which may be opened to insert said wipes into said container or remove said wipes from said container;

b) a renewable energy source attached or integral to said container, said energy source including a container storing fuel in a fluid or gas form;

c) a heat source attached or integral to said container and providing heat in response to said fuel;

d) a heat control attached or integral to said container and operative to control the temperature of said wipes inside said container within a range of temperatures by regulating the amount of said fuel consumed thereby and thus the amount of heat produced by said heat source of c).

3. A portable warmer for wipes and the like including in combination:

a) a container having a rigid or semi-rigid opening arrangement which may be opened to insert said wipes into said container or remove said wipes from said container;

b) a renewable energy source attached or integral to said container said energy source including a container storing exothermic fuel;

c) a heat source attached or integral to said container and providing heat in response to said fuel;

d) a heat control attached or integral to said container and operative to control the temperature of said wipes inside said container within a range of temperatures by regulating said fuel consumed thereby and thus the amount of heat produced by said heat source of c).

4. A warmer as claimed in claim 1, 2 or 3 further including in combination:

e) a second heat control operative to prevent said temperature of said wipes from exceeding a known value wherein said temperature of said wipes is sensed in one of the following manners:

a) directly, b) indirectly, c) utilizing a thermostatic control containing a bimetallic strip, d) utilizing a thermocouple which produces varying electric potentials in response to varying temperature, e) utilizing a thermally sensitive electronic element which changes resistance in response to varying temperature, f) utilizing a thermally sensitive electronic element which changes junction voltage in response to varying temperature, g) utilizing an optical sensor which senses the optical radiation given off by said wipes.

5. A warmer as claimed in claim 1, 2 or 3 wherein in element c) said heat source operates to provide heat by burning, oxidization or catalytic conversion of a chemical form of said energy and in element d) heat is controlled by controlling the amount of said chemical form of said energy provided to said heat source of c).

6. A warmer as claimed in claim 1, 2 or 3 wherein in element d) when said temperature is within said range the generation of heat by element c) may be turned off.

7. A warmer as claimed in claim 1, 2 or 3 wherein said container of element a) consists of one of:

a) a durable rigid container, b) a durable semi-rigid container, c) a container having dimensions permitting carrying with one hand, d) a container wherein said opening arrangement facilitates one hand operation and removal of items therefrom, e) a container having a hinged lid, f) a container wherein said opening arrangement includes a lid having a fastener, which fastener may be operated with the fingers and/or thumb, g) a container having a hinged lid which may be opened with one hand for removing a wipe, said lid having a shallow shape with said hinged disposed on one edge with a fastening clasp disposed on the edge opposite the hinged edge, said clasp designed to be operated by a thumb or single finger, h) a container having insulation to prevent heat loss from said wipes, i) a container having provision for storing, heating and making accessible articles in addition to said wipes, j) a container having provision for storing, heating and making accessible at least one article of the group consisting of: baby bottle, pacifier, diaper or baby clothing in addition to said wipes.

8. A warmer as claimed in claim 1, 2 or 3 wherein said wipes consist of one of the group of:

a) baby wipes, b) swabs, c) mops, d) cloths, e) pads, f) towels, g) towelettes, h) tissues, i) soft cloths, j) paper towels.

9. A warmer as claimed in claim 1, 2 or 3 wherein said wipes are one of:

a) dry, b) moistened, c) medicated, d) moistened for the purpose of cleaning infants, or e) medicated for the purpose of medicating infants.

10. A warmer as claimed in claim 1, 2 or 3 wherein in said element d) a temperature sensing element is operative to sense said temperature of said wipes in one of the following manners:

a) directly, b) indirectly, c) utilizing a thermostatic control containing a bimetallic strip, d) utilizing a thermocouple which produces varying electric potentials in response to varying temperature, e) utilizing a thermally sensitive electronic element which changes resistance in response to varying temperature, f) utilizing a thermally sensitive electronic element which changes junction voltage in response to varying temperature, g) utilizing a thermally sensitive heating element which changes resistance in response to varying temperature, h) utilizing an optical sensor which senses the optical radiation given off by said wipes.

11. A method of portably storing and warming wipes and the like including the steps of:

a) providing a container for storing said wipes, said container having an opening arrangement which may be opened to insert said wipes into said container or remove said wipes from said container;

b) providing a renewable energy source attached or integral to said container for storing energy in gaseous, liquid, or or chemical form;

c) providing a heat source attached or integral to said container and operative to convert energy from said energy source to provide heat;

d) controlling the amount of heat provided in step c) to maintain the temperature of said wipes in said container within a range of temperatures by sensing the temperature of said wipes inside said container and regulating the amount of heat produced by said heat source of step c).

12. A method for storing and warming wipes and the like including the steps of:

a) placing said wipes in a container having a stiff opening arrangement which may be opened to remove said wipes therefrom;

b) providing stored energy via a portable renewable energy source which includes a container for storing fuel in a fluid or gas form;

c) converting said fuel from step b) to heat;

d) sensing the temperature of said wipes and controlling the heat produced in step c) to maintain said temperature within a range of temperatures.

13. A method of providing heated wipes while traveling including the steps of:

a) providing said wipes in a portable container having a stiff opening arrangement which may be opened to remove said wipes from said container;

b) providing exothermic fuel stored in a removable fuel container;

c) heating said wipes by chemical reaction of said fuel;

d) controlling the temperature of said wipes within a range by sensing the temperature thereof and in response thereto controlling the amount of said heat produced in step c).

14. A method as claimed in claim 11, 12 or 13 including the further step of:

e) separately from step d), preventing said temperature of said wipes from exceeding a known value by sensing said temperature in one of the following manners:

a) directly, b) indirectly, c) utilizing a thermostatic control containing a bimetallic strip, d) utilizing a thermocouple which produces varying electric potentials in response to varying temperature, e) utilizing a thermally sensitive electronic element which changes resistance in response to varying temperature, f) utilizing a thermally sensitive electronic element which changes junction voltage in response to varying temperature, g) utilizing an optical sensor which senses the optical radiation given off by said wipes.

15. A method as claimed in claim 11, 12 or 13 wherein in step c) said heat source operates to provide heat by burning, oxidization or catalytic conversion of a chemical form of said energy and in step d) heat is controlled by controlling the amount of said chemical form of said energy provided to said heat source of c).

16. A method as claimed in claim 11, 12 or 13 wherein in step d) when said temperature is within said range the generation of heat by step c) may be turned off.

17. A method as claimed in claim 11, 12 or 13 wherein said container of step a) consists of one of:

a) a durable rigid container, b) a durable semi-rigid container, c) a container having dimensions permitting carrying with one hand, d) a container wherein said opening arrangement facilitates one hand operation and removal of items therefrom, e) a container having a hinged lid, f) a container wherein said opening arrangement includes a lid having a fastener, which fastener may be operated with the fingers and/or thumb, g) a container having a hinged lid which may be opened with one hand for removing a wipe, said lid having a shallow shape with said hinged disposed on one edge with a fastening clasp disposed on the edge opposite the hinged edge, said clasp designed to be operated by a thumb or single finger, h) a container having insulation to prevent heat loss from said wipes, i) a container having provision for storing, heating and making accessible articles in addition to said wipes, j) a container having provision for storing, heating and making accessible at least one article of the group consisting of: baby bottle, pacifier, diaper or baby clothing in addition to said wipes.

18. A method as claimed in claim 11, 12 or 13 wherein said wipes consist of one of:

a) baby wipes, b) swabs, c) mops, d) cloths, e) pads, f) towels, g) towelettes, h) tissues, i) soft cloths, j) paper towels.

19. A method as claimed in claim 11, 12 or 13 wherein said wipes are one of:

a) dry, b) moistened, c) medicated, d) moistened for the purpose of cleaning infants, or e) medicated for the purpose of medicating infants.

20. A method as claimed in claim 11, 12 or 13 wherein in said step d) said temperature of said wipes is sensed by a temperature sensing element operative to sense said temperature of said wipes in one of the following manners:

a) directly, b) indirectly, c) utilizing a thermostatic control containing a bimetallic strip, d) utilizing a thermocouple which produces varying electric potentials in response to varying temperature, e) utilizing a thermally sensitive electronic element which changes resistance in response to varying temperature, f) utilizing a thermally sensitive electronic element which changes junction voltage in response to varying temperature, g) utilizing a thermally sensitive heating element which changes resistance in response to varying temperature, h) utilizing an optical sensor which senses the optical radiation given off by said wipes.

* * * * *